US008087946B2

(12) United States Patent
Namiki et al.

(10) Patent No.: US 8,087,946 B2
(45) Date of Patent: Jan. 3, 2012

(54) POWER ADAPTER HAVING A REPLACEABLE PLUG

(75) Inventors: Seiji Namiki, Chung Ho (TW); Wei-Sheng Chao, Chung Ho (TW)

(73) Assignee: Tamura Power Technology Co., Ltd., Chungo Ho (TW)

( * ) Notice: Subject to any disclaimer, the term of this patent is extended or adjusted under 35 U.S.C. 154(b) by 0 days.

(21) Appl. No.: 12/752,170

(22) Filed: Apr. 1, 2010

(65) Prior Publication Data

US 2011/0053410 A1 Mar. 3, 2011

(30) Foreign Application Priority Data

Aug. 27, 2009 (TW) ..... 98215802 U

(51) Int. Cl.
*H01R 29/00* (2006.01)

(52) U.S. Cl. ..... 439/173; 439/170

(58) Field of Classification Search ..... 439/131, 439/170–177, 518, 638, 956
See application file for complete search history.

(56) References Cited

U.S. PATENT DOCUMENTS

| | | | | |
|---|---|---|---|---|
| 5,684,689 | A * | 11/1997 | Hahn | 363/146 |
| 6,086,395 | A * | 7/2000 | Lloyd et al. | 439/172 |
| 6,227,888 | B1 * | 5/2001 | Hahn | 439/173 |
| 7,264,492 | B2 * | 9/2007 | Liang | 439/171 |
| 7,300,297 | B1 * | 11/2007 | Wang | 439/173 |
| 7,439,709 | B2 * | 10/2008 | Bumiller | 320/114 |
| 7,874,853 | B2 * | 1/2011 | Chiang et al. | 439/173 |

* cited by examiner

*Primary Examiner* — Thanh Tam Le
(74) *Attorney, Agent, or Firm* — Alan Kamrath; Kamrath IP Lawfirm, PA

(57) ABSTRACT

A power adapter having a replaceable plug has a body having a recess formed in the body and an engagement mechanism inside the recess. A plug, slidably mounted inside the recess, has a bottom board having an engagement mechanism thereon and is slid so that the engagement mechanism of the plug engages or disengages the engagement mechanism inside the recess. A fixing cover is mounted inside the recess and is slidably moved to a first location and a second location. When located at the first location, the fixing cover is located inside the recess, the bottom board abuts the plug fixed inside the recess, and the plug is retrained restrained from moving. When located at the second location, the fixing cover is partially moved away from the recess and maintains a distance to the bottom board, and the plug can be removed from the recess.

6 Claims, 7 Drawing Sheets

C-C

A-A

E-E

POWER ADAPTER HAVING A REPLACEABLE PLUG

BACKGROUND OF THE INVENTION

1. Field of the Invention

The present invention is related to a power adapter and, more particularly, to a power adapter having a replaceable plug.

2. Description of the Related Art

Normally, to acquire power for operation, a power adapter of an electric appliance needs to be plugged in a power socket. The power adapter has a plug mounted thereon to correspond to a power socket having a matching specification. Depending on country or region, the specifications of the power plug and the power socket may not be the same. As a result, a power adapter having a plug fails to be plugged in a power socket if the plug does not match the specification of the power socket.

To solve the issue, many vendors developed power adapters having detachable or replaceable plug structures so as to adapt to power sockets having different specifications. With reference to FIG. 9, a replaceable plug structure disclosed in Taiwanese patent publication no. 200922042 "Replaceable plug structure of a power adapter" has an adapter body (91), a plug seat (92) and a fixing cover (93). The adapter body (91) has a recess (94). The plug seat (92) has an engagement mechanism (95). The plug seat (92) is mounted in the recess (94) and can be moved to one side of the recess (94) to engage the adapter body (91) through the engagement mechanism (95). The fixing cover (93) is pivotally mounted to one side of the plug seat (92) and has two wedges (96). When the plug seat (92) engages the adapter body (91), the fixing cover (93) can be pivoted to cover the exposed portion of the recess (94), and the wedges (96) can be fixed on the adapter body (94). Hence, the plug seat (92) is locked on the adapter body (91) without moving inside the recess (94). The plug seat (92) is unlocked by flipping over the fixing cover (93) upwardly.

Given the conventional replaceable plug structure, the wedges (96) respectively engage with recesses (94) formed on an inner wall of the recess (94). When the fixing cover (93) is flipped over downwardly, the wedges (96) must slide through the inner wall of the recess (94) before entering the recesses (94). When being released from the recesses (94), the wedges (96) also slide through the inner wall of the recess (94). After being used for a long while, the wedges (96) and the inner wall of the recess (94) are worn out due to the abrasion contacts therebetween. Such wearing finally ends up with the loss of engagement function, so that the fixing cover (93) fails to be fastened within the adapter body (91) any more.

SUMMARY OF THE INVENTION

An objective of the present invention is to provide a power adapter having a replaceable plug improving the drawback of the fixing cover being unusable after long-term operation.

To achieve the foregoing objective, the power adapter has a body, a plug and a fixing cover.

The body has a recess, two connection strips and a body engagement mechanism. The recess is formed inside the body. The two connection strips are mounted inside the recess. The body engagement mechanism is mounted inside the recess.

The plug is slidably mounted inside the recess and has a bottom board, a plug engagement mechanism and at least two conductive prongs. The plug engagement mechanism engages or disengages the body engagement mechanism when the plug is slidably moved inside the recess. The at least two conductive prongs are mounted on the bottom board, and are respectively connected with the two connection strips when the plug engagement mechanism engages the body engagement mechanism.

The fixing cover is mounted inside the recess and is slidably moved to a first location or a second location. The fixing cover is located inside the recess and abuts the plug fixed in the recess when the fixing cover is positioned at the first location. The fixing cover is partially moved out of the recess and maintains a distance to the bottom board of the plug when the fixing cover is positioned at the second location.

When the plug of the present invention is mounted inside the body, the fixing cover is moved to the second location and is partially moved out of the recess. Then, the plug is placed in the recess and is slid so that the plug engagement mechanism engages the body engagement mechanism, and the fixing cover is moved to the first location in completion of the mounting. The fixing cover now is adjacent to the bottom board of the plug and is restrained from moving. When the plug of the present invention is demounted from the body, the fixing cover is moved to the second location, and the plug is slid to disengage the engagement between the two engagement mechanism. Therefore, the plug can be removed from the recess.

DETAILED DESCRIPTION OF THE INVENTION

Figure 1:
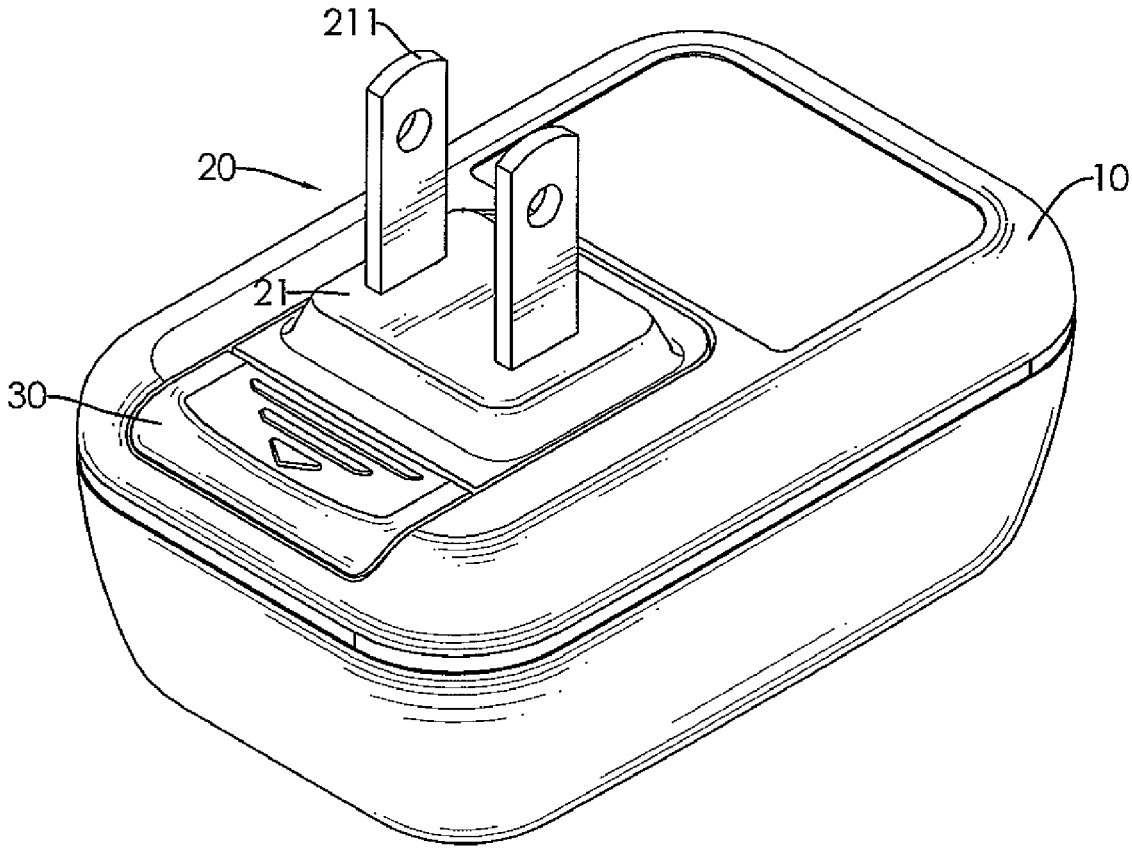
FIG. 1 is a perspective view of a power adapter having a replaceable plug in accordance with the present invention.
Figure 2:
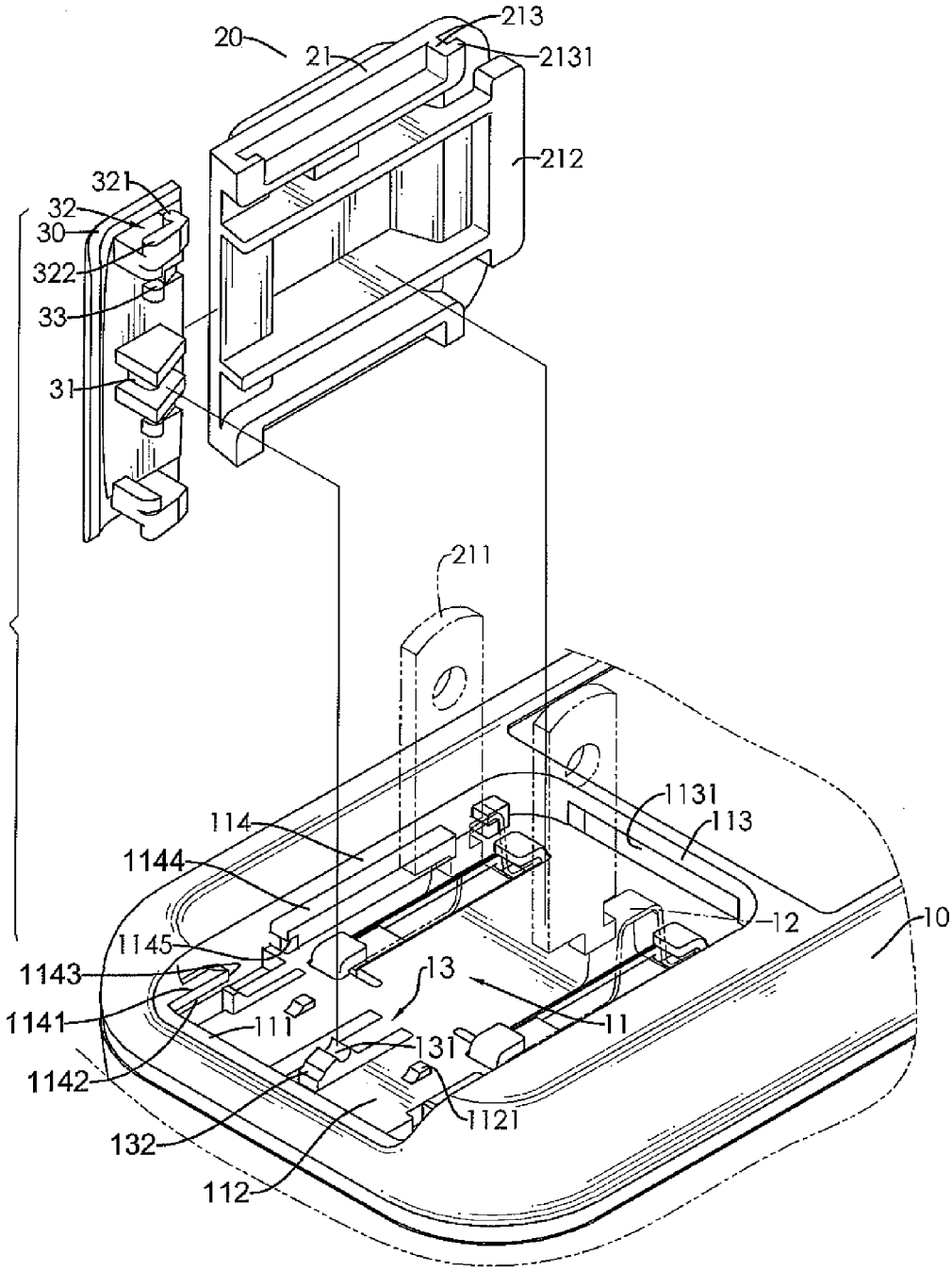
FIG. 2 is an exploded perspective view of the power adapter having a replaceable plug in FIG. 1.
Figure 3:
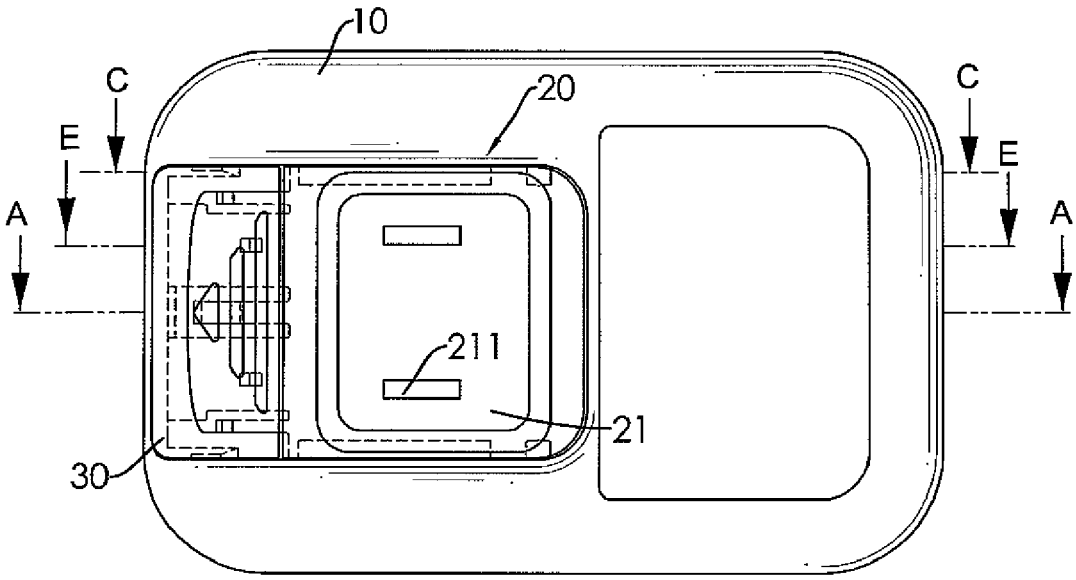
FIG. 3 is a top view of the power adapter having a replaceable plug in FIG. 1.

With reference to FIGS. 1 to 3, a first embodiment of a power adapter having a replaceable plug in accordance with the present invention has a body (10), a plug (20) and a fixing cover (30).

The body (10) is hollow and has electronic components (not shown) mounted therein. The body (10) has a recess (11), an opening (111), two connection strips (12), a resilient beam (13), a slot (1131), two stoppers (1141), and at least two engagement blocks (1144). The recess (11) is formed in the body (10). The opening (111) is formed through one side of the recess (11). The recess (11) has a bottom wall (112), a rear wall (113) and two side walls (114). The two connection strips (12) are mounted on the bottom wall (112) and connected with electronic components mounted inside the body (10). The resilient beam (13) is formed by cutting through the bottom wall (112) to generate a free end. The resilient beam has a first arced groove (131) and a second arced groove (132) separately formed on the resilient beam (13). The first arced groove (131) is more distant from the opening (111) relative to the second arced groove (132) and is positioned higher than the second arced groove (132). The slot (1131) is formed in the rear wall of the recess (11). The two stoppers (1141) respectively protrude from the two side walls (114), and each has a bottom side (1142) and a rear side (1143) opposite to the opening (111). The at least two engagement blocks (1144) respectively protrude from the two side walls (114) of the recess (11). Each of the at least two engagement blocks (1144) has a cutaway corner (1145) recessed from one side of the engagement block (1144) facing the opening (111) and abutting the bottom wall (112).

Figure 4:
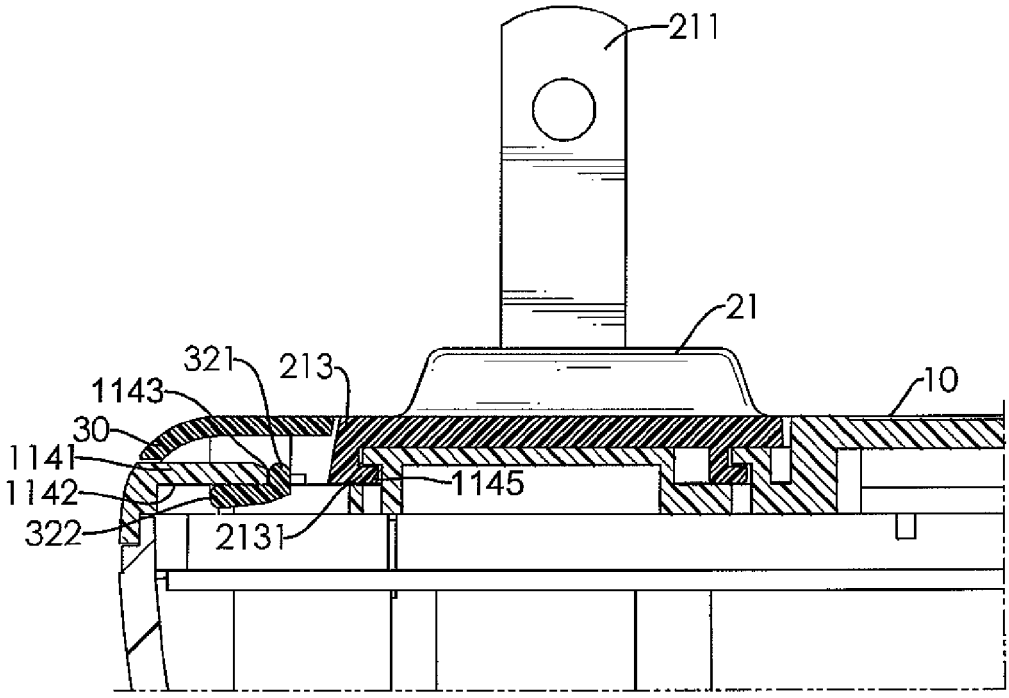
FIG. 4 is a cross-sectional view of the power adapter having a replaceable plug taken along line C-C in FIG. 3 when a fixing cover is positioned at a first location.
Figure 5:
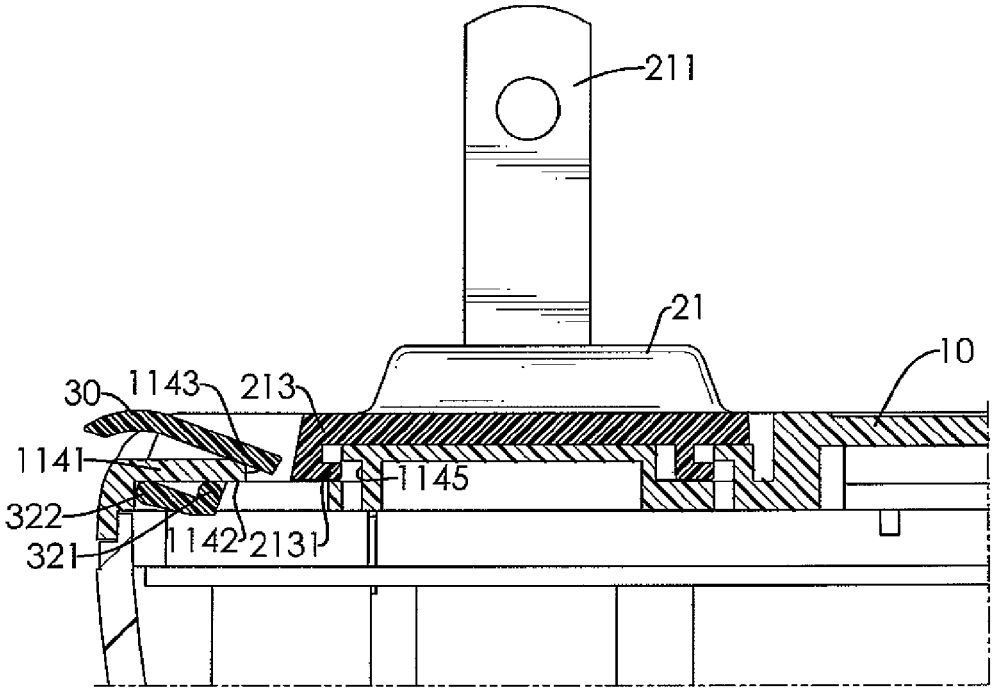
FIG. 5 is another cross-sectional view of the power adapter having a replaceable plug taken along line C-C in FIG. 3 when the fixing cover is positioned at a second location.
Figure 6:
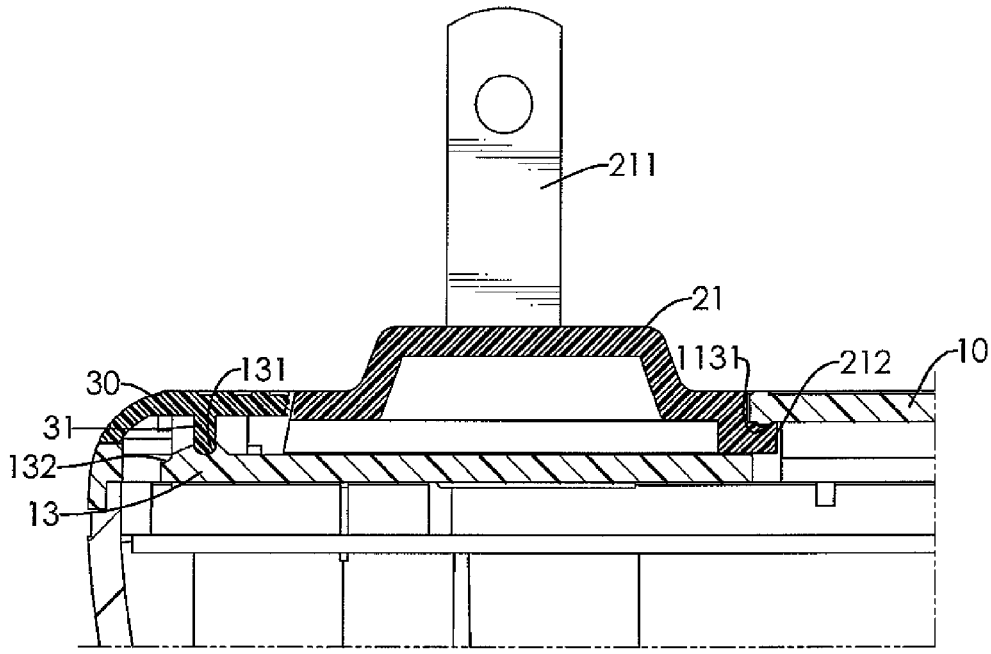
FIG. 6 is a cross-sectional view of the power adapter having a replaceable plug taken along line A-A in FIG. 3 when the fixing cover is positioned at the first location.
Figure 7:
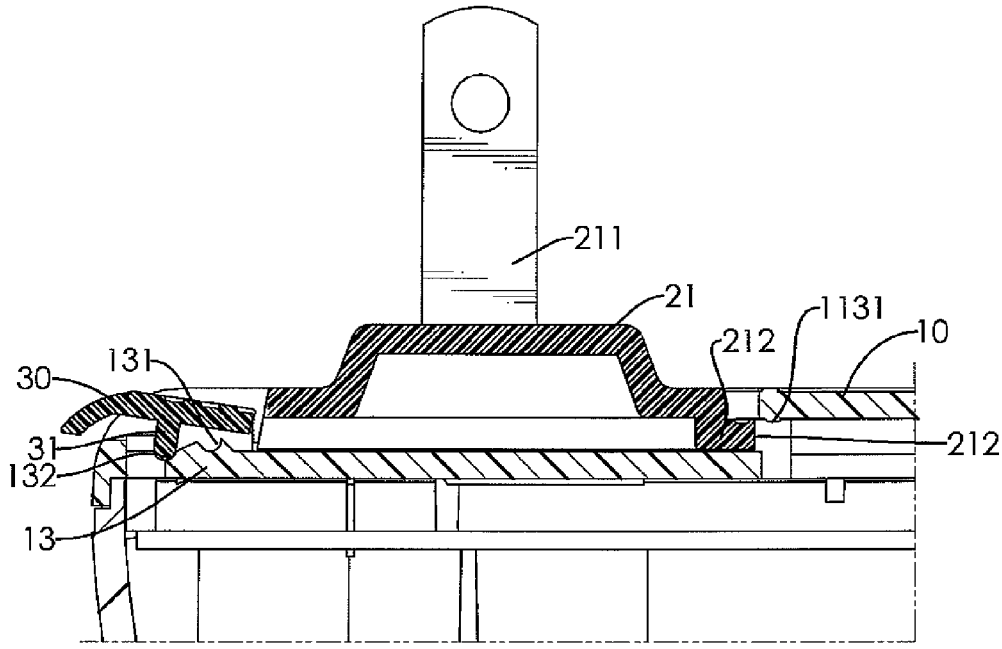
FIG. 7 is another cross-sectional view of the power adapter having a replaceable plug taken along line A-A in FIG. 3 when the fixing cover is positioned at the first location.

With reference to FIGS. 4 and 5, the plug (20) can be slidably mounted in the recess (11). The plug (20) has a bottom board (21) and at least two conductive prongs (211). The at least two conductive prongs (211) are mounted through the bottom board (21). Given two conductive prongs (211) in the first embodiment, the bottom board (21) has an engagement structure and an insertion block (212). The engagement structure of the bottom board (21) engages the engagement structure inside the recess (11). To implement the engagement structure of the bottom board (21), the bottom board (21) has at least two engagement blocks (213), and each of the at least two engagement blocks (213) has a protrusion (2131) to engage the cutaway corner (1145) of the engagement block (1144) mounted inside the recess (11). The insertion block (212) matches the slot (1131) on the rear wall (113) of the recess (11). When the plug (20) and the engagement structure thereof engages the engagement structure inside the recess (11), the insertion block (212) inserts in the slot (1131), and the two conductive prongs (211) are respectively contacted with the two connection strips (12) of the body (10).

With reference to FIGS. 4 to 7, the fixing cover (30) is slidably mounted inside the recess (11) of the body (10) and is located at the opening (111). The fixing cover (30) has a positioning block (31) and two urging portions (32). An edge of the positioning block (31) selectively urges against one of the first arced groove (131) and the second arced groove (132). Each urging portion (32) takes an L-like form and has a side urging piece (321) and a bottom urging piece (322). The bottom urging piece (322) urges against a bottom of the corresponding stopper (1141) inside the recess (11) so that the fixing cover (30) does not come off from the body (10). When the edge of the positioning block (31) urges against the first arced groove (131), the elastic force of the resilient beam (13) supports the fixing cover (30) so that the side urging piece (321) urges against the rear side (1143) of the stopper (1141) to prevent the fixing cover (30) from sliding away from the recess (11). Meanwhile, the fixing cover (30) is positioned at a first location and is held inside the recess (11).

When a force is exerted on the fixing cover (30), the resilient beam (13) is pushed by the positioning block (31) to bent downwardly, and the side urging piece (321) also moves downwardly. When the fixing cover (30) is further pushed away from the recess (11), the positioning block (31) disengages the first arced groove (131) and moves to the lower second arced groove (132), and the side urging piece (321) moves to a bottom side (1142) of the stopper (1141). Meanwhile, the fixing cover (30) is positioned at a second location, and a part of the fixing cover (30) slides away from the recess (11) through the opening (111).

When the plug (20) is mounted onto the body (10), the fixing cover (30) is first positioned at the second location and then, is placed in the recess (11). The fixing cover (30) is slid so that the engagement structure of the bottom board (21) engages the engagement structure inside the recess (11) and the insertion block (212) is inserted in the slot (1131). The fixing cover (30) is then moved to the first location. As the fixing cover (30) is adjacent to the bottom board (21) of the plug (20) now, the plug (20) can be restrained from moving. When the current plug (20) is replaced with another plug having a different specification, the fixing cover (30) is moved to the second location, the plug (20) is slid inside the recess (11) to disengage the two engagement structures, and the insertion block (212) is pulled out of the slot (1131). Thus, the plug (20) can be demounted from the recess (11). Repeating the process described above can mount another plug in the body (10).

Given the operation of the resilient beam (13), the positioning block (31), the stopper (1141) and the urging portion (32), the fixing cover (30) can be mounted on the body (10) to switch between the first location and the second location so as to solve the worn-out problems resulting from the abrasive contact between the wedges and the recess and having the drawback that the fixing cover (30) fails to be fixed on the body.

Figure 8:
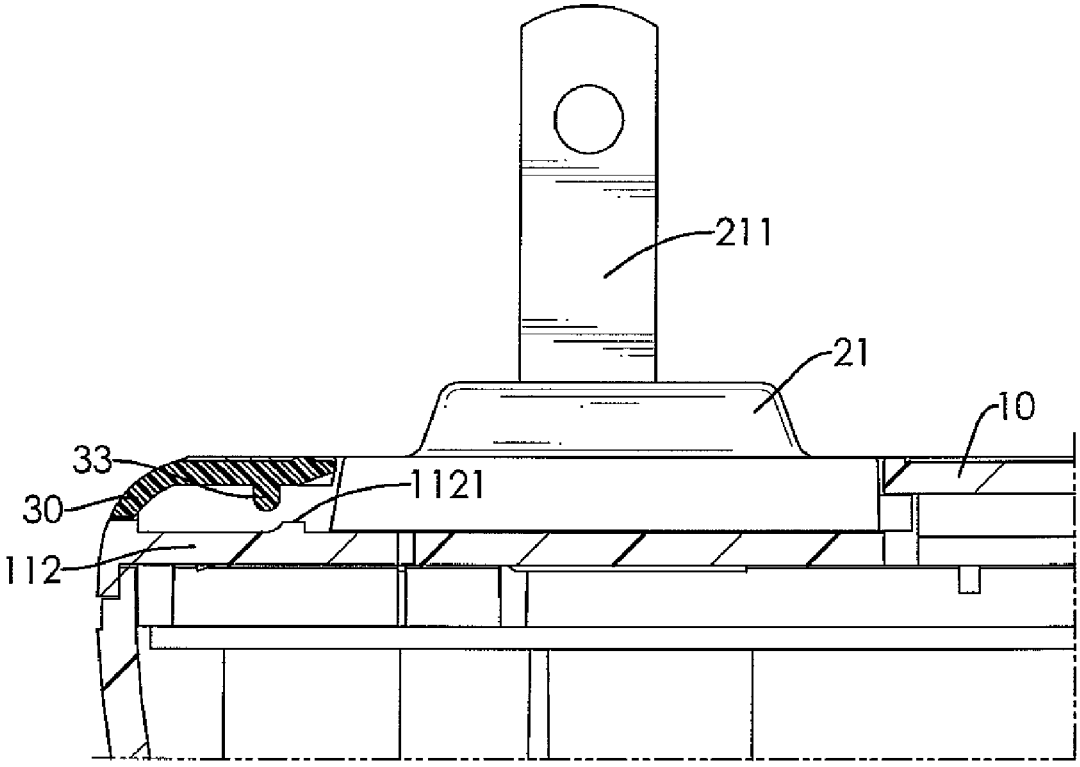
FIG. 8 is a third cross-sectional view of the power adapter having a replaceable plug taken along line E-E in FIG. 3 when the fixing cover is positioned at the first location.
Figure 9:
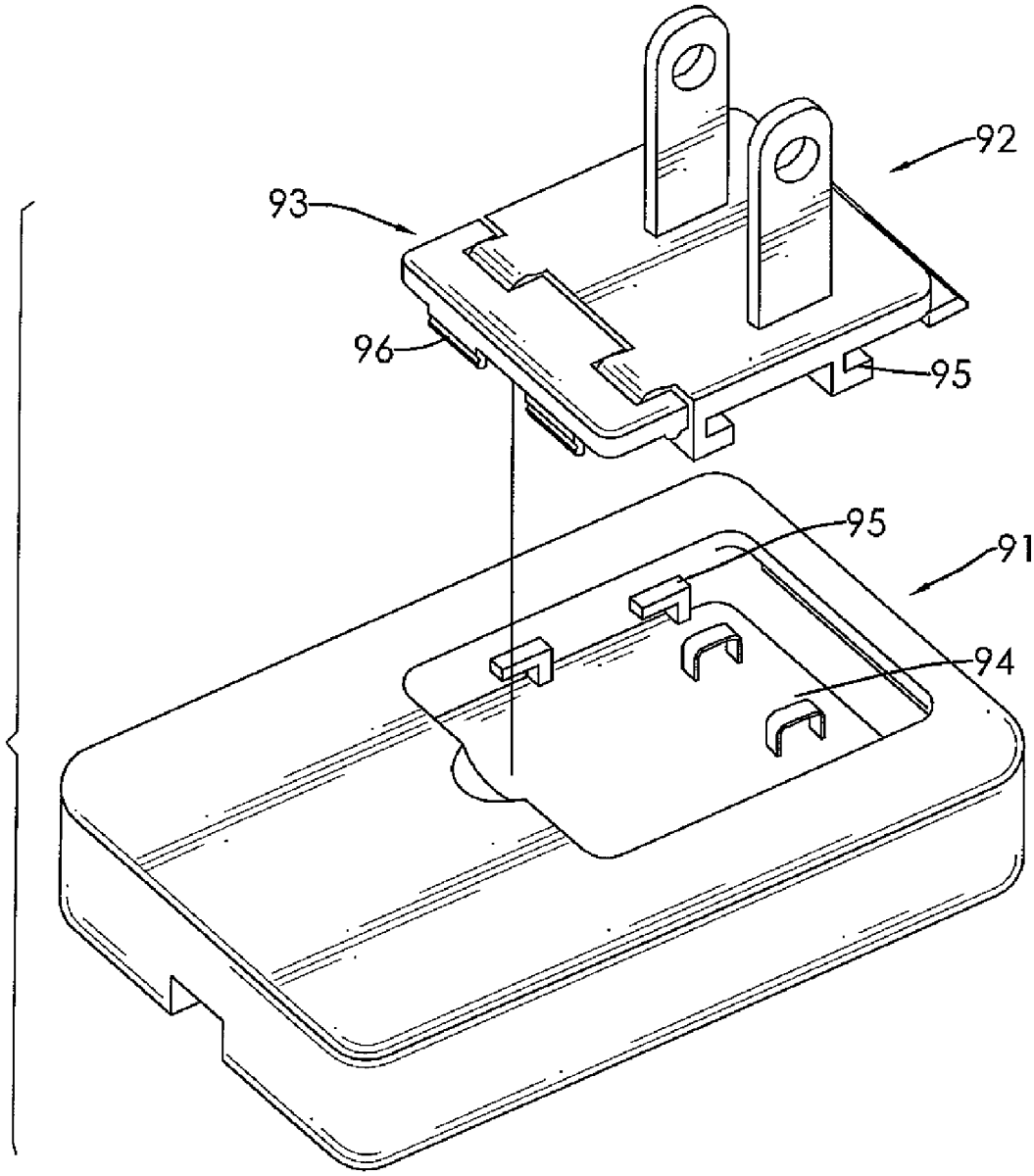
FIG.9 PRIOR ART
FIG. 9 is a conventional replaceable plug structure of a power adapter.

With reference to FIG. 8, the bottom wall (112) of the recess (11) further has at least one guiding seat (1121). An arced surface is formed on a side of the guiding seat (1121) facing the opening (111). A guiding piece (33) is formed on the fixing cover (30) to correspond to the arced surface of the guiding seat (1121). The free end of the guiding piece (33) takes an arced form and aligns with the arced surface of the guiding seat (1121). When a force is exerted on the fixing cover (30), the guiding piece (33) abuts against the arced surface of the guiding seat (1121), and the fixing cover (30) is smoothly slid along the arced surface to move toward the opening (111).

Even though numerous characteristics and advantages of the present invention have been set forth in the foregoing description, together with details of the structure and function of the invention, the disclosure is illustrative only. Changes may be made in detail, especially in matters of shape, size, and arrangement of parts, within the principles of the invention to the full extent indicated by the broad general meaning of the terms in which the appended claims are expressed.

What is claimed is:

1. A power adapter having a replaceable plug, comprising:

a body comprising:

a recess formed therein and having a bottom wall and two side walls;

two connection strips mounted inside the recess;

a body engagement mechanism mounted inside the recess;

an opening formed through one side of the recess;

two connection strips mounted on the bottom wall;

a resilient beam formed on the bottom wall and having a first arced groove and a second arced groove separately formed on the resilient beam, wherein the first arced groove is more distant from the opening relative to the second arced groove and is positioned higher than the second arced groove; and two stoppers respectively protruding from the two side walls and respectively having a bottom side and a rear side opposite to the opening;

a plug slidably mounted inside the recess and comprising:

a bottom board;

a plug engagement mechanism engaging or disengaging the body engagement mechanism when the plug is slidably moved inside the recess; and at least two conductive prongs mounted on the bottom board and respectively connected with the two connection strips when the plug engagement mechanism engages the body engagement mechanism; and a fixing cover mounted inside the recess and slidably moved to a first location or a second location, with the fixing cover located inside the recess and abutting the plug fixed in the recess when the fixing cover is positioned at the first location, and with the fixing cover partially moved out the recess and maintaining a distance to the bottom board of the plug when the fixing cover is positioned at the second location, wherein the fixing cover comprises:

a positioning block, with an edge of the positioning block selectively urging against one of the first arced groove and the second arced groove; and two urging portions, with each urging portion taking an L-like form and having a side urging piece; and a bottom urging piece urging against a bottom of the corresponding stopper inside the recess;

wherein the side urging piece urges against the rear side of the stopper and the fixing cover is positioned at the first location when the edge of the positioning block urges against the first arced groove, and wherein the side urging piece is located underneath a bottom of the stopper and the fixing cover is positioned at the second location and partially slides away from the recess through the opening when the edge of the positioning block urges against the second arced groove.

2. The power adapter as claimed in claim 1, wherein at least one guiding seat is mounted on the bottom wall of the recess and has an arced surface formed on a side of the guiding seat facing the opening; and a guiding piece is formed on the fixing cover to correspond to the arced surface of the guiding seat, and a free end of the guiding piece takes an arced form and aligns with the arced surface of the guiding seat.

3. The power adapter as claimed in claim 1, wherein the body further comprises at least two engagement blocks respectively protruding from the two side walls of the recess, the at least two engagement blocks constitute the body engagement mechanism inside the recess of the body, and each of the at least two engagement blocks has a cutaway corner recessed from one side of the engagement block facing the opening and abutting the bottom wall; and the bottom board has at least two engagement blocks, the at least two engagement blocks constitutes the plug engagement mechanism on the bottom board of the plug, and each of the at least two engagement blocks has a protrusion to engage the cutaway corner of the engagement block inside the recess.

4. The power adapter as claimed in claim 2, wherein the body further comprises at least two engagement blocks respectively protruding from the two side walls of the recess, the at least two engagement blocks constitute the body engagement mechanism inside the recess of the body, and each of the at least two engagement blocks has a cutaway corner recessed from one side of the engagement block facing the opening and abutting the bottom wall; and the bottom board has at least two engagement blocks, the at least two engagement blocks constitutes the plug engagement mechanism on the bottom board of the plug, and each of the at least two engagement blocks has a protrusion to engage the cutaway corner of the engagement block inside the recess.

5. The power adapter as claimed in claim 3, wherein the recess further comprises a rear wall and a slot is formed in the rear wall; and the bottom board has an insertion block matching the slot.

6. The power adapter as claimed in claim 4, wherein the recess further comprises a rear wall and a slot is formed in the rear wall; and the bottom board has an insertion block matching the slot.

* * * * *